United States Patent [19]

Chance, Jr.

[11] 4,241,805

[45] Dec. 30, 1980

[54] HIGH PRESSURE GAS VENT NOISE CONTROL APPARATUS AND METHOD

[75] Inventor: Calvin L. Chance, Jr., Dallas, Tex.

[73] Assignee: Vibration and Noise Engineering Corporation, Dallas, Tex.

[21] Appl. No.: 26,189

[22] Filed: Apr. 2, 1979

[51] Int. Cl.[3] ..... F01N 7/02; F01N 1/24

[52] U.S. Cl. ..... 181/232; 181/258; 181/267; 181/272; 181/281

[58] Field of Search ..... 181/222, 224, 230, 232, 181/247, 252, 258, 267, 270, 272, 280, 281, 279, 226; 138/44, 42; 251/127

[56] References Cited

U.S. PATENT DOCUMENTS

| | | | |
|---|---|---|---|
| 2,563,509 | 8/1951 | Baird | 181/226 |
| 3,635,309 | 1/1972 | Nemeawsky et al. | 181/267 |
| 3,665,965 | 5/1972 | Baumann | 251/127 X |
| 3,724,502 | 4/1973 | Hayner et al. | 138/44 X |
| 3,813,079 | 5/1974 | Baumann et al. | 251/127 |
| 3,823,743 | 7/1974 | King | 138/42 |
| 3,917,221 | 11/1975 | Kubota et al. | 251/127 |
| 4,109,680 | 8/1978 | Lavender | 138/42 X |

*Primary Examiner*—L. T. Hix
*Assistant Examiner*—Benjamin R. Fuller
*Attorney, Agent, or Firm*—Craig & Antonelli

[57] ABSTRACT

An apparatus and method is provided for venting high pressure gas to a lower pressure region with a minimum of noise. A high pressure vent valve controls egress from a high pressure gas source. In order to limit the generation of noise downstream of the vent valve, at least one control orifice is provided which is configured to have a flow velocity through a throat section thereof of the speed of sound, and with a pressure downstream of the throat being the same as the throat pressure. In this manner, the pressure is reduced by about half at each control orifice, with no or little noise generation. Downstream of these sonic velocity control orifices, sound attenuating means including radially extended passages lined with sound-baffling structure are provided to reduce any residual noise in the flowing gas as it passes into the region of lower pressure.

27 Claims, 6 Drawing Figures

HIGH PRESSURE GAS VENT NOISE CONTROL APPARATUS AND METHOD

BACKGROUND AND SUMMARY OF THE INVENTION

The present invention relates to venting apparatus for venting high pressure gas to a region of lower pressure. For example, pumping systems or compressor station piping for natural gas and the like require venting systems to relieve excess pressures under certain conditions. Such venting arrangements are necessary in applications where emergency venting valves are required to relieve the system in the event of dangerous pressure build-ups. Due to the very high pressure involved in these types of systems, such high pressure gas vents are a serious source of noise, which noise must be suppressed and controlled in order to satisfy safety and environmental limitations, especially if they are to be located anywhere near populated residential areas.

Sound muffling systems used on pneumatic powered jack hammers and on internal combustion engines cannot be readily adapted to high pressure gas vents of the type contemplated by the present invention due to the exhibited different noises generated. The noise from jack hammers and such engines is mostly of low frequency with the frequency of highest amplitude being around 40 Hz (cycles per second) and the sound is composed of this fundamental frequency and harmonics of this fundamental frequency. This noise is also primarily a discrete correlated type of noise which depends on the rotational speed of the equipment generating same.

On the other hand, high pressure vent noise is more of a random type noise in that it is made up of very many small discrete sources such that it exhibits a noise spectrum that has a major peak at 1,000 to 2,000 Hz with a roll off of 3 db per octave (decibels) above and 40 db per octave below. Thus a graph of this noise spectrum would exhibit a rather haystack looking appearance. In other words, practically all frequencies would be present in the high pressure vent noise, whereas in the lower frequency engine noise you only have the fundamental and harmonics related thereto.

Also, these engine systems are operated essentially at atmospheric pressure, while the pressure drop involved in the gas venting systems contemplated by the present invention may be in the range of 40 to 20,000 psi (pounds per square inch).

In the past, two basic approaches have been used to control noise caused by such high pressure gas vents. A first of these approaches is to arrange a duct at the downstream side of the vent valve, which duct permits uncontrolled expansion of the gas from the valve, and which duct leads into a silencer. Upon entry into the silencer, the noise is then silenced before its exit to an area of low pressure. This approach allows the maximum amount of noise to be generated and then applies the silencing mechanism to reduce that noise to an acceptable level. Exemplary of this approach are the Model 561 and 563 silencers for atmospheric service and the Model 711 and 721 silencers for closed pressure system service marketed by the assignee for the present application. Although these silencer arrangements work quite well, there are certain drawbacks in that the piping or ducting downstream and upstream from the high pressure valve, as well as the silencer, are subjected to very intense aerodynamic forces, sometimes necessitating expensive constructional measures to avoid their deterioration or destruction. Furthermore, with such systems, the ducting used to transport the gas from the high pressure valve to the silencer mechanism is not always adequate to contain the noise generated by the valve such that this ducting will frequently have to have an acoustical treatment itself, thereby further complicating the manufacture of the venting system with attendant increased construction costs.

Another approach previously utilized for such venting systems was to provide a valve which itself had a very large number of small tortuous paths therein. This type of valve, a so-called "drag valve," provides that the total pressure drop from the high pressure side of the valve to an area of lower pressure takes place without substantial pressure discontinuity, thereby reducing the noise source. This drag valve approach also claims to shift the frequency spectrum of the generated noise to much higher frequencies and therefore makes better use of the atmospheric absorption between the venting noise source and the observer when the high pressure is vented to atmosphere. Drawbacks to this particular approach are that the small tortuous paths in such a vent valve are easily clogged by any foreign material that may be in the pipeline, and further, the manufacture and machining of the small tortuous paths is very expensive. In certain instances, the interior trim (material forming the tortuous paths) of such drag valves will wear out within a matter of a few months, requiring expenditures for new trim that is almost as great as the price of the original valve. The downtime time necessitated by repair and replacement of such drag valves is also costly.

In U.S. Pat. No. 4,113,050, a fluid-flow noise reduction system is disclosed which includes a pipe section having some nine (9) separate orifice plates arranged in series and designed to ensure subsonic flow through each plate, with a further silencer element connected in line downstream of the orifice plates. These plates each include large numbers of apertures and apparently are intended to function like the tortuous path valves mentioned above, to minimize the pressure discontinuities, and therewith the sound, as the gas pressure is progressively lowered. This arrangement is disadvantageous in that the apertured plates in the duct require high manufacturing costs and increase the space required. Also, the small apertures in these plates would appear to be subject to clogging and wear, much as are the drag valve constructions discussed above.

The present invention relates to improved apparatus and methods for controlling the noise in high pressure gas vents, which overcome the above-mentioned disadvantages of the prior approaches. More specifically, the present invention contemplates an arrangement which substantially reduces the amount of noise generated by the vented gas, with preferred embodiments of the invention including at least one control orifice disposed downstream of the high pressure region and configured to permit passage of the gas therethrough at sonic throat velocity with the pressure of the gas downstream of the control orifice throat being the same as the pressure at the throat, whereby maximum gas flow through the control orifices is assured while the pressure energy of the gas is reduced stepwise at each of the control orifices with minimum noise generation. This approach takes advantage of the fact that substantially less noise is generated during the stepwise reduction in the pressure energy of the vented gas flow, as along as one maintains the conditions that the throat velocity is sonic and the pressure downstream of the throat is the same as the pressure at the throat. No shock generated noise occurs because the only possible occurring shock is a normal shock at the orifice throat. Since the pressure downstream of the throat is the same as at the immediately preceding control orifice throat, there is no generation of downstream shock patterns. Further this arrangement optimizes and maximizes the throughflow since the highest throat velocity feasible is sonic velocity. Furthermore, since the pressure downstream of the throat is maintained the same as the throat pressure, there is no need to provide large downstream piping to accommodate expansion of the flow.

The above-mentioned control orifice system of the present invention is quite simple to design, since one needs to only know the maximum upstream high pressure to determine the orifice size. Also, given the maximum high pressure to be expected at the high pressure source, one can calculate the number of control orifices that will be needed to sufficiently lower the pressure energy so that the noise producing efficiency of the flow is substantially reduced to the point where the generated noise can be readily dampened by minimum sound baffling means.

In preferred embodiments of the invention, a sound silencer stage is provided downstream of the last control orifice, which silencer stage includes passage leading to the low pressure region, which passages are lined with sound dampening materials. Although it is contemplated to utilize the invention with various types of silencer stages, especially preferred embodiments include radially extending passages which are lined with sound baffling material. In these last-mentioned preferred embodiments, the radially extending passages are configured so as to provide balanced forces on the silencer apparatus so as to minimize the structural loads that would otherwise be due to the aerodynamic flow-through.

The apparatus and methods contemplated by the present invention exhibit many advantages, including:

(i) The velocity control orifices for stepping down the pressure without generation of noise are quite simple and economical to design and build. As indicated above, one need only know the maximum upstream pressure that must be accommodated, in order to determine the number and geometry of the control orifices needed. Since the pressure downstream of the respective sonic velocity throats of the control orifices is at the corresponding throat pressure, there are no major constraints as to the diametric or length dimension of the chambers intermediate the orifices. Consequently, the design can be utilized with relatively long piping paths between control orifices, and can also be used for rather compact constructions. Further, since only a single central orifice is provided at each of the respective pressure step-down stages, very easy to construct thick rigid orifice plates can be used.

(ii) The total weight of the sound attenuating system for a given high pressure condition to be vented can be minimized, by including rather small distances between the respective control orifices, with corresponding small amounts of constructional casing material required. The possibility of such lightweight construction is advantageous in limiting material cost and in solving design problems in applications where weight is a critical factor, such as for high pressure gas vents located very high on a building tower.

(iii) The design is very reliable and relatively maintenance free. Since rather large holes are provided for the control orifices, the danger of the same being clogged by impurities in the gas flow is minimized.

(iv) This design exhibits maximum flow efficiency by maintaining sonic velocity at the throat through each of the control orifices.

(v) Preferred embodiments including radial passages for the silencer stages downstream of the control orifices are particularly advantageous in that the aerodynamic loading on the silencer structure is balanced, thereby further limiting the constructional requirements and total weight necessary.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
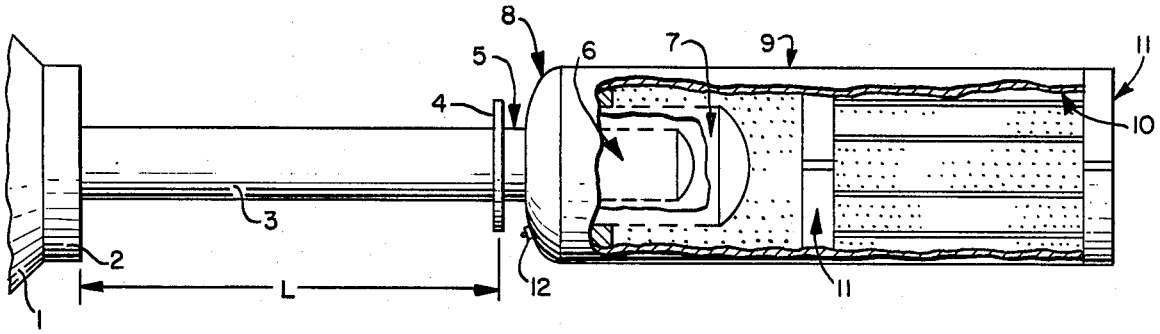
FIG. 1. (PRIOR ART)
FIG. 1 is a schematic, part-sectional side view depicting a prior art vent silencing arrangement.

Throughout the various drawing figures, like reference numerals are used to designate like structure.

Referring to FIG. 1, a prior art vent silencer arrangement is illustrated for purposes of background information. In FIG. 1, a high pressure gas source 1 is schematically shown immediately upstream of a high pressure vent valve 2. The outlet of vent valve 2 is transmitted via a relatively long pipe or duct 3 to inlet flange 4 of a silencer. This pipe 3 is on the order of 100 feet long in certain installations. The silencer includes an inlet nozzle 5 which leads to a primary diffuser 6, followed by a secondary diffuser 7. Each of the diffusers includes a plurality of orifices for transmission of the gas. The housing for the silencer includes an external head 8 and a shell 9. Sound-absorptive pack material 10 is provided along the inside of the shell 9. Splitter supports 11 are provided to accommodate support and mounting of the silencer. A drain plug 12, which is maintained in the plugged condition except for intermittent removal of accumulated moisture, is also provided. Such a vent silencer arrangement is marketed by Vibration and Noise Engineering Corporation of Dallas, Texas, assignee of the present appliction, as Model 563. This prior art arrangement utilizes the above-discussed approach wherein relatively uncontrolled expansion takes place in the pipe 3 between the valve 2 and the silencer, with the silencer then including provisions to suppress the noise prior to its final exhaustion to atmosphere or the surrounding low pressure region.

Figure 2:
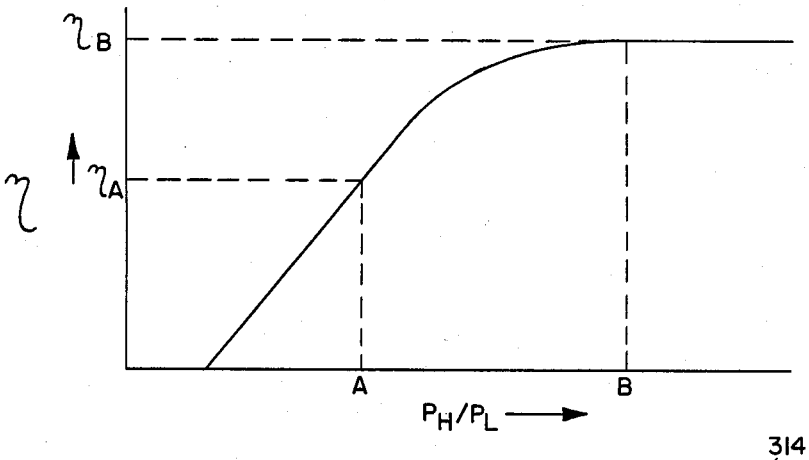
FIG. 2 is graph schematically depicting the noise generating efficiency of the vent gas flow from the high pressure region to a low pressure region as a function of the ratio of the high pressure to the low pressure.

FIG. 2 is a graph showing the relationship between the pressure differential $P_H/P_L$ ($P_H$=the pressure of a high pressure region and $P_L$=the pressure of a low pressure region and the noise generating efficiency $\eta$ ($\eta$=mass flow/ec$^2$). C=speed of sound and e=density in the medium involved. As you can see from FIG, 2, at low pressure ratios, the efficiency of noise generation for the flow of gas between the two pressures increases steadily (note that $\eta$ is on a logarithmic scale), with a leveling off of the noise generation efficiency at very high pressure ratios. At the pressure ratio B, and higher pressure ratios, the noise generation efficiency is on the order of $5 \times 10^{-3}$. However, at the lower pressure ratio depicted at point A, the efficiency $\eta_A$ is only $8 \times 10^{-8}$. Accordingly, if the pressure ratio can be reduced from the pressure at point B down onto the sloped curve at A, for example, the noise generating efficiency of the flow is reduced drastically. As will be explained more fully below, the present invention takes advantage of this phenomena and provides a practical construction for shifting this pressure ratio down into the lower region such as depicted by point A in FIG. 2, wherein the noise generation efficiency of the mass flow is very low so that the necessary sound absorbing steps that have to be taken are rather minimal, as compared to what would be required for systems having the very high pressure ratios and corresponding high noise generating efficiencies of the region exemplified by point B in FIG. 2.

Figure 3:
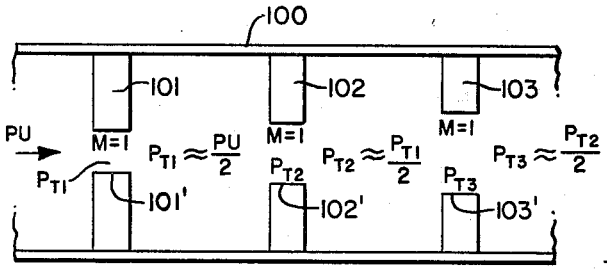
FIG. 3 is a shcematic view depicting certain operating principles of control orifice pressure energy reducing stages constructed in accordance with preferred embodiments of the present invention.

FIG. 3 schematically depicts the operational principles applied by the present invention to reduce the pressure ratio, and therewith the sound generating efficiency, while also maintaining optimum throughflow conditions. In FIG. 3, reference character 100 indicates a tubular confining member for confining flow from a high pressure upstream pressure region at pressure $P_U$. A first orifice plate 101 is provided which includes an orifice opening 101' which is designed based upon the upstream pressure $P_U$ to have sonic flow (Mach 1 or M=1) conditions at the throat of orifice 101'. This system is furthermore designed so that the pressure downstream of the orifice 101' is the same as the throat pressure $P_{T1}$. With this system a pressure drop of approximately ½ of the pressure $P_U$ takes place in the transition through the orifice plate 101. In like manner further stepwise pressure drops take place at each of orifice plates 102 and 103 having correspondingly designed orifices 102', 103'. The relative pressure drops and pressure at each of the positions along the length of the tubular guide 100 are indicated in the FIG. 3 schematic illustration. Note that in each instance, the orifices are designed to assure Mach 1 flow at the throats, with the pressure downstream of the throat being the same as the preceding throat pressure. In the event of a reduction in the upstream pressure, the rightmost or downstream most orifice would be the first to lose its sonic velocity condition, with the remaining upstream orifices maintaining the sonic velocity condition and likewise the above-mentioned stepwise substantial pressure drop, without generation of noise due to the propagation of shocks or the like.

Figure 4:
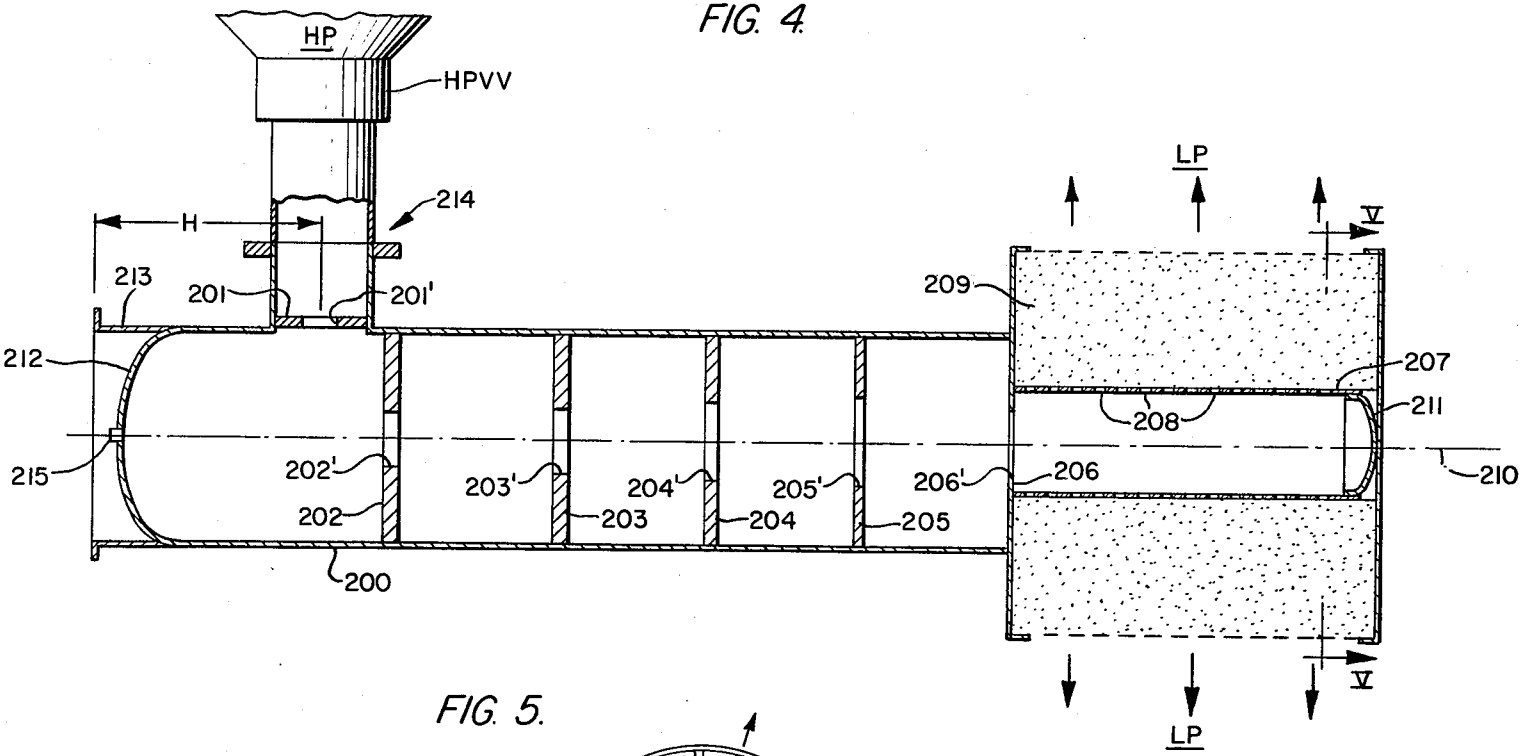
FIG. 4 is a sectional side view of high pressure gas venting apparatus constructed in accordance with a preferred embodiment of the invention.
Figure 5:
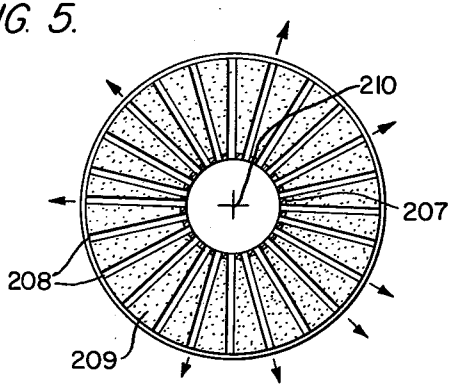
FIG. 5 is a sectional schematic view taken along lines V—V of FIG. 4.

FIG. 4 illustrates a preferred practical embodiment of a high pressure gas vent noise apparatus constructed in accordance with the present invention. A tubular housing 200 is provided, which accommodates the venting of gas from a high pressure region HP via a high pressure vent valve HPVV. A first orifice plate 201 is provided which has an orifice 201' designed to assure sonic throat velocity therethrough. In like manner, each of the orifice plates 202, 203, 204, 205 and 206 are dimensioned and disposed to have sonic flow conditions at their respective throat sections 202', 203', 204', 205' and 206'. As schematically depicted in the drawing, the control orifice openings are progressively larger, as dictated by the respective decreases in pressure as the flow passes through each of the respective orifice plates. This FIG. 4 embodiment is designed based upon a high pressure region HP having a pressure of 2350 psi with a low pressure region schematically depicted by LP at atmosphere. Downstream of the control orifice 206' at the end of the tubular member 200, a further tubular member 207 is connected, which tubular member supports and forms part of a sound attenuating stage. This tubular member 207 includes a plurality of radially extending passages 208 (see FIG. 5) which passages are lined with sound-absorption panels 209 for attenuating the sound remaining in the flow as it passes from tubular member 207 and out to the low pressure region LP. In this regard, it is noted that the orifice plates, 202–206, and passages, 208, are configured and disposed to have subsonic flow into the passages 208 of substantially the pressure of the low pressure region. In this FIG. 4 arrangement, the passages 208 and the panels 209 extend radially from the central axis 210 of the tubular members 200 and 206, thereby assuring a balancing of the forces acting upon these tubular members and their corresponding supporting structure. The noise control apparatus of FIG. 4 further includes a cap member 211 for closing off the righthand end of the tubular member 207 and a cap member 212 closing off the lefthand end of the tubular member 200. In order to support the noise control apparatus in an in use position, a mounting flange arranement 213 is provided which is attached to the end cap 212 and the tubular member 200. This flange 213 is configured so as to accommodate vertical positioning of the control apparatus, with the flange 213 at the bottom and the central axis 210 extending vertically. Furthermore, connecting flange structure and pipe structure 214 is provided for connecting with the high pressure vent valve HPVV. Also, it is contemplated to provide drain plugs schematically depicted at 215 to accommodate removal of any moisture that may collect.

The embodiment illustrated in FIG. 4 is specifically designed to accommodate the low noise venting of gas having a high pressure pressure of about 2350 psi and a low pressure LP at atmosphere. The following table contains respective dimensions in inches for preferred practical embodiments having 12" and 18" nominal inlet pipe sizes for these assured pressure conditions.

| Nominal Size | H | $D_1$ | $T_1$ | $D_2$ | $T_2$ | $L_2$ | $D_3$ | $T_3$ | $L_3$ | $D_4$ | $T_4$ | $L_4$ | $D_5$ | $T_5$ | $L_5$ | $D_6$ | $T_6$ |
|---|---|---|---|---|---|---|---|---|---|---|---|---|---|---|---|---|---|
| 12" | 22 | .78 | .375 | 1.07 | 1 | 6 | 1.47 | .75 | 6 | 2.01 | 5 | 6 | 2.77 | .5 | 6 | 3.80 | .25 |
| 18" | 22 | 1.23 | .375 | 1.69 | 1 | 6 | 2.32 | .75 | 6 | 3.19 | 5 | 6 | 4.38 | .5 | 9 | 6.01 | .25 |

Figure 6:
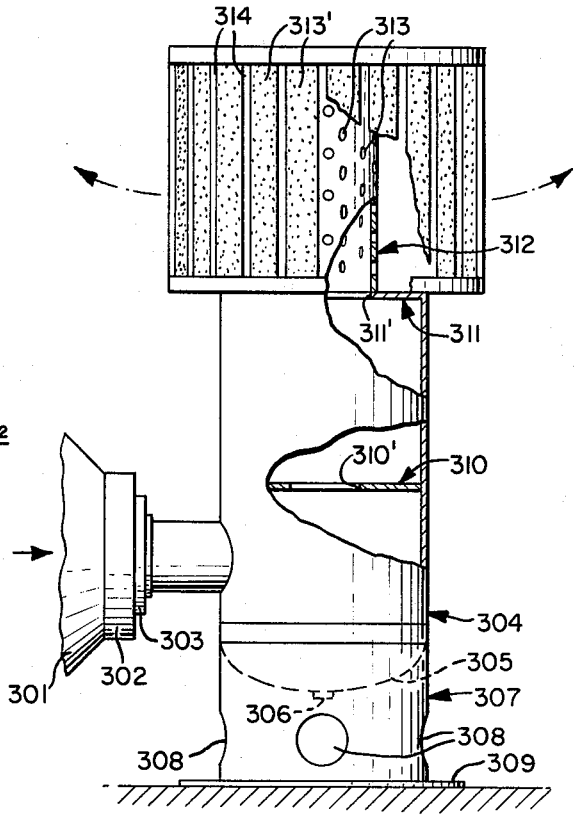
FIG. 6 is a schematic view showing a high pressure gas venting apparatus constructed in accordance with another preferred embodiment of the invention.

FIG. 6 schematically depicts another rpreferred embodiment of the invention which has a high pressure source 301 communicated by valve 302 to opening 303 into a vertically standing tubular shell 304. The bottom of this shell 304 is bounded by an end cap shown in dashed lines at 305 with a corresponding drain plug 306. Extension 307 of tubular member 304 includes mounting holes 308 accommodating mounting of the assembly in the position shown on a base 309. A first orifice plate 310 having a control aperture 310' is provided, as well as a second aperture plate 311 and control orifice 311' at the junction of the tubular member 304 and the tubular member 312 which forms the support for the second silencing stage. This silencing stage, in a manner similar to that described above for the FIG. 4 embodiment, includes openings 313 to the tubular member 312, which openings communicate with radially extending passages 314. These passages 314 are lined with sound absorbing material such as fiberglass insulation material 313' and serve to deaden any residual sound left in the gas being vented to the surrounding atmosphere. This embodiment of FIG. 6 differs from the FIG. 4 embodiment primarily in that only two orifice plates and corresponding control orifices are provided, since this FIG. 6 system is designed for a substantially lower pressure differential.

While I have shown and described several embodiments in accordance with the present invention, it is understood that the same is not limited thereto but is susceptible to numerous changes and modifications as known to those skilled in the art and I therefore do not wish to be limited to the details shown and described herein but intend to cover all such changes and modifications as are encompassed by the scope of the appended claims.

I claim:

1. High pressure gas vent noise control apparatus for controlling the noise emitted during venting of gas from a high pressure region to a low pressure region via a high pressure vent valve at the high pressure region; said apparatus comprising:

a tubular member and a plurality of control orifices positioned longitudinally spaced from each other within said tubular member, said control orifices being configured and disposed such that vented gas passes therethrough with sonic velocity being attained at a respective throat of each of said orifices and the pressure downstream thereof is stepwise reduced relative to the pressure upstream thereof, and flow control means downstream of said control orifices for controlling the discharge of said gas to said low pressure region.

2. Apparatus according to claim 1, wherein said flow control means includes a noise suppression stage having passages communicating said gas directly to said low pressure region, and wherein sound-baffling means are disposed along said passages.

3. Apparatus according to claim 1, wherein each of said plurality of control orifices is formed as a relatively large aperture in an orifice plate.

4. Apparatus according to claim 3, wherein the respective control orifices are progressively larger in the downstream direction of the flow of said gas.

5. Apparatus according to claim 4, wherein the respective orifice plates are progressively thinner in the downstream direction of the flow of said gas.

6. Apparatus according to claim 3, wherein the respective orifice plates are progressively thinner in the downstream direction of the flow of said gas.

7. Apparatus according to claim 3, wherein said flow control means includes a noise suppression stage having passages communicating said gas directly to said low pressure region, and wherein sound-baffling means are disposed along said passages.

8. Apparatus according to claim 7, wherein said noise suppression stage includes a second tubular member disposed downstream of and connected to said first tubular member, and wherein said passages extend radially out of said second tubular member.

9. Apparatus according to claim 8, further comprising mounting flange means attached to the end of said first tubular member opposite said second tubular member, said flange means being configured to mount said first and second tubular members so that they extend vertically.

10. Apparatus according to claim 9, further comprising inlet flange means for accommodating fluid connection of said first tubular member with the output of a vent valve disposed at the high pressure region.

11. Apparatus according to claim 10, wherein a first, most upstream, of said control orifices is disposed immediately adjacent the opening of said inlet flange means to said first tubular member, and wherein further of said control orifices are centrally arranged in respective ones of said orifice plates disposed in said first tubular member.

12. Apparatus according to claim 11, wherein said orifice plates and passages are configured and disposed to have subsonic flow into said passages at substantially the pressure of the low pressure region.

13. Apparatus according to claim 7, wherein said orifice plates and passages are configured and disposed to have subsonic flow into said passages at substantially the pressure of the low pressure region.

14. Apparatus according to claim 3, wherein said tubular member and said orifice plates are made of steel, and wherein said orifice plates are welded in position in said tubular member.

15. Apparatus according to claim 3, wherein each of said plurality of orifice plates are located spaced along a constant diameter section of a tubular member.

16. Apparatus according to claim 15, wherein the distance between each successive pair of orifice plates is equal.

17. Apparatus according to claim 1 or 15, wherein said control orifices are axially aligned along the longitudinal center axis of said tubular member.

18. Apparatus according to claim 3, wherein each orifice plate has a single one of said relatively large control orifices through which gas is passed at sonic velocity.

19. Apparatus according to claim 1 or 14, wherein said low pressure region is the atmosphere.

20. High pressure gas vent noise control apparatus for controlling the noise emitted during venting of gas from a high pressure region at a low pressure region via a high pressure vent valve at the high pressure region; said apparatus comprising:

a tubular member and a plurality control orifices positioned within said tubular member, wherein at least an upstream-most one of said control orifices is configured and disposed such that vented gas passes therethrough with sonic velocity at a throat thereof, said upstream-most orifice being the only orifice at its longitudinal position within said tubular member; and flow control means downstream of said plurality of control orifices for controlling the discharge of said gas to said low pressure region.

21. Apparatus according to claim 20, wherein at least said upstream-most one of said control orifices is formed as a relatively large aperture in an orifice plate.

22. Apparatus according to claim 20 or 21, wherein each of said plurality of control orifices are axially aligned along the longitudinal center axis of said tubular member.

23. Method of venting gas from a high pressure region to a low pressure region while controlling noise emitted therefrom comprising the steps of:

(a) passing all of said gas through a plurality of control orifices that are longitudinally spaced along a flow path between said high and low pressure regions and configured for causing said gas to pass therethrough with sonic velocity being attained at a respective throat of each control orifice and the pressure downstream of each control orifice being reduced relative to the pressure upstream thereof; and (b) controlling the flow of said gas downstream of said control orifices to said low pressure region.

24. Method of venting gas from a high pressure region to a low pressure while controlling noise emitted therefrom comprising the steps of:

(a) passing all of said gas through a plurality of control orifices positioned within a flow path between said high and low pressure regions, wherein at least an upstream-most one of said control orifices is configured and disposed so as to cause said gases to pass through a throat thereof at sonic velocity, said upstream-most orifice being the only control orifice at its longitudinal position within said flow path; and (b) controlling the flow of said gases downstream of said control orifices to said low pressure region.

25. Method according to claim 23 or 24, wherein said controlling includes suppressing the noise generated by said gas by means of sound-baffling means disposed along passages for said gas.

26. Method according to claim 25, wherein all of said plurality of said control orifices are provided downstream of one another so that the gas flows serially therethrough.

27. Method according to claim 26, wherein said orifices are configured and disposed to assure subsonic flow into said passages at substantially the pressure of the low pressure region.

* * * * *